US007643040B1

(12) United States Patent
Gabrielson et al.

(10) Patent No.: US 7,643,040 B1
(45) Date of Patent: Jan. 5, 2010

(54) SYSTEM AND METHOD FOR ENHANCING GRAY SCALE OUTPUT ON A COLOR DISPLAY

(75) Inventors: Donn E. Gabrielson, Everett, WA (US); Richard L. Fix, Bothell, WA (US)

(73) Assignee: SonoSite, Inc., Bothell, WA (US)

( * ) Notice: Subject to any disclaimer, the term of this patent is extended or adjusted under 35 U.S.C. 154(b) by 1003 days.

(21) Appl. No.: 10/821,198

(22) Filed: Apr. 8, 2004

(51) Int. Cl.
*G09G 5/02* (2006.01)

(52) U.S. Cl. ..... 345/690; 345/596; 345/89; 345/692

(58) Field of Classification Search ..... 345/596, 345/89, 690, 692
See application file for complete search history.

(56) References Cited

U.S. PATENT DOCUMENTS

| | | | | |
|---|---|---|---|---|
| 4,389,672 | A * | 6/1983 | Bowen et al. | 348/574 |
| 5,155,478 | A | 10/1992 | Sekiya et al. | |
| 5,400,053 | A | 3/1995 | Johary et al. | |
| 5,670,986 | A | 9/1997 | Leak | |
| 5,793,883 | A * | 8/1998 | Kim et al. | 382/128 |
| 6,618,056 | B1 | 9/2003 | Spekowius et al. | |
| 6,618,206 | B2 | 9/2003 | Tarakci et al. | |
| 6,663,567 | B2 | 12/2003 | Ji et al. | |
| 6,685,645 | B1 | 2/2004 | McLaughlin et al. | |
| 6,714,206 | B1 * | 3/2004 | Martin et al. | 345/589 |
| 6,733,455 | B2 | 5/2004 | Mo et al. | |
| 6,773,399 | B2 | 8/2004 | Xi et al. | |
| 6,788,306 | B2 * | 9/2004 | Yamaguchi et al. | 345/596 |
| 6,866,631 | B2 | 3/2005 | McLaughlin et al. | |
| 6,866,632 | B1 | 3/2005 | Chou et al. | |
| 6,894,670 | B2 * | 5/2005 | Funakoshi et al. | 345/89 |
| 6,896,658 | B2 | 5/2005 | Ji et al. | |
| 6,936,008 | B2 | 8/2005 | Tarakci et al. | |
| 6,980,419 | B2 | 12/2005 | Smith et al. | |
| 2002/0180751 | A1 * | 12/2002 | Rozzi | 345/589 |
| 2003/0004414 | A1 | 1/2003 | McLaughlin et al. | |
| 2003/0052979 | A1 | 3/2003 | Soga et al. | |
| 2003/0080982 | A1 | 5/2003 | Steven et al. | |
| 2005/0131294 | A1 | 6/2005 | Ji et al. | |

FOREIGN PATENT DOCUMENTS

DE 2003/10224234 1/2003

OTHER PUBLICATIONS

The Authoritative Dictionary of IEEE Standard Terms 7th Edition, 2000, p. 330 published by Standards Information Network IEEE Press.*

* cited by examiner

*Primary Examiner*—Bipin Shalwala
*Assistant Examiner*—Afroza Y Chowdhury
(74) *Attorney, Agent, or Firm*—Fulbright & Jaworski L.L.P.

(57) ABSTRACT

There is disclosed a system and method for enhancing gray scale output on a color display. Various gray intensities are mapped based on an image made of various shades of gray so that a viewer perceives a depth of gray levels beyond those available in gray scale from the color display. Pseudo shades of gray are displayed between the levels of true gray that typically are displayed in order to provide a smoother transition between the levels of true gray that are displayed.

20 Claims, 4 Drawing Sheets

*FIG. 1*
*(PRIOR ART)*

| GOAL INTENSITY | ACTUAL INTENSITY | RED DRIVE | GREEN DRIVE | BLUE DRIVE | |
|---|---|---|---|---|---|
| 0 | 0 | 0 | 0 | 0 | ; BLACK |
| 1 | 0 | 0 | 0 | 0 | |
| 2 | 0 | 0 | 0 | 0 | |
| 3 | 0 | 0 | 0 | 0 | |
| 4 | 1 | 1 | 1 | 1 | ; FIRST TRUE GRAY |
| 5 | 1 | 1 | 1 | 1 | |
| 6 | 1 | 1 | 1 | 1 | |
| 7 | 1 | 1 | 1 | 1 | |
| 8 | 2 | 2 | 2 | 2 | ; SECOND TRUE GRAY |
| 9 | 2 | 2 | 2 | 2 | |
| 10 | 2 | 2 | 2 | 2 | |
| 11 | 2 | 2 | 2 | 2 | |
| 12 | 3 | 3 | 3 | 3 | ; THIRD TRUE GRAY |
| . | . | . | . | . | |
| . | . | . | . | . | |
| . | . | . | . | . | |
| 248 | 62 | 62 | 62 | 62 | ; SIXTY SECOND TRUE GRAY |
| 249 | 62 | 62 | 62 | 62 | |
| 250 | 62 | 63 | 62 | 62 | |
| 251 | 62 | 62 | 62 | 62 | |
| 252 | 63 | 63 | 63 | 63 | ; WHITE |
| 253 | 63 | 63 | 63 | 63 | |
| 254 | 63 | 63 | 63 | 63 | |
| 255 | 63 | 63 | 63 | 63 | |
| 255 | 63 | 63 | 63 | 63 | |

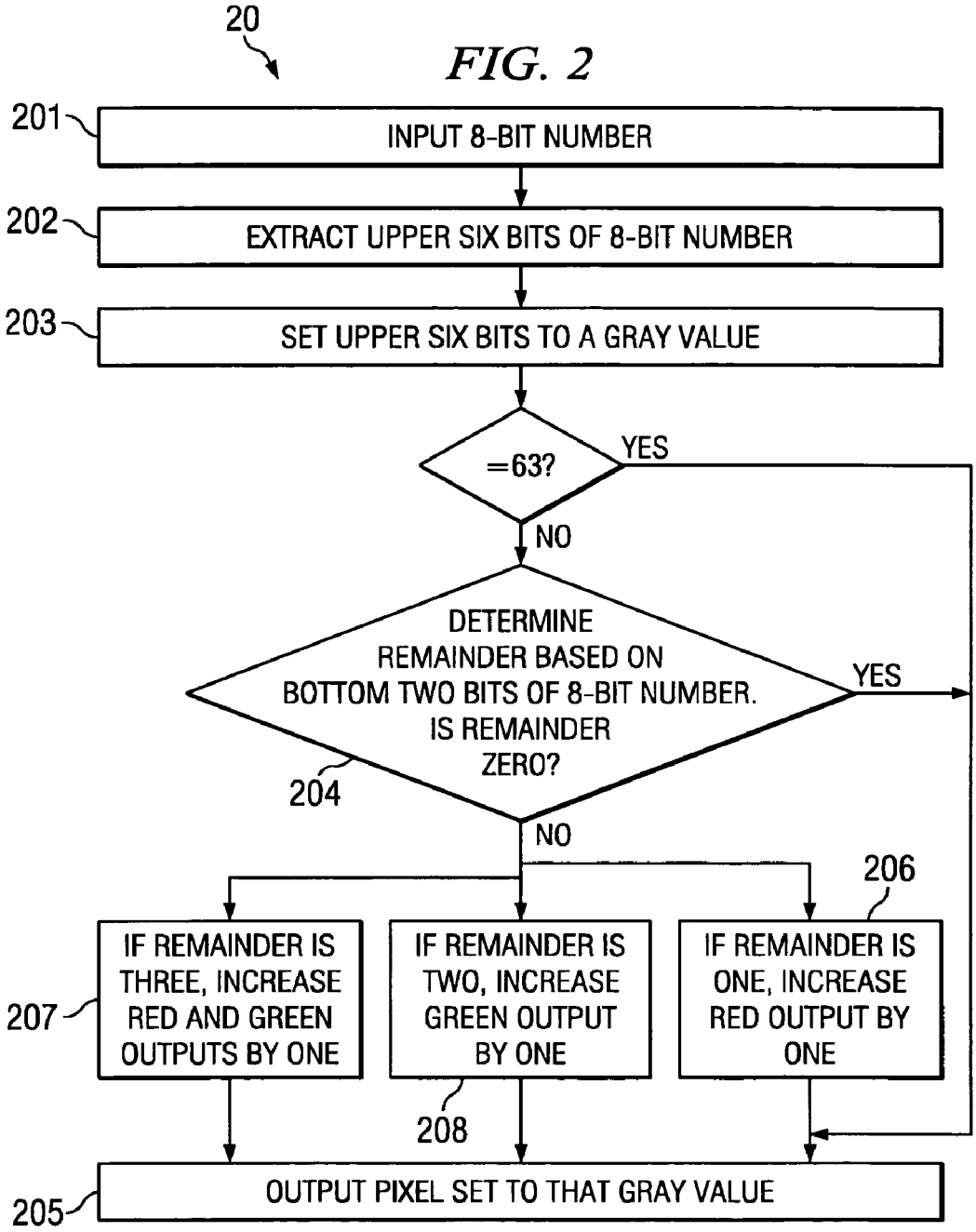
20
FIG. 2
201
INPUT 8-BIT NUMBER
202
EXTRACT UPPER SIX BITS OF 8-BIT NUMBER
203
SET UPPER SIX BITS TO A GRAY VALUE
=63?
YES
NO
DETERMINE REMAINDER BASED ON BOTTOM TWO BITS OF 8-BIT NUMBER. IS REMAINDER ZERO?
YES
204
NO
206
IF REMAINDER IS THREE, INCREASE RED AND GREEN OUTPUTS BY ONE
IF REMAINDER IS TWO, INCREASE GREEN OUTPUT BY ONE
IF REMAINDER IS ONE, INCREASE RED OUTPUT BY ONE
207
208
205
OUTPUT PIXEL SET TO THAT GRAY VALUE

| GOAL INTENSITY | ACTUAL INTENSITY | RED DRIVE | GREEN DRIVE | BLUE DRIVE | |
|---|---|---|---|---|---|
| 0 | 0 | 0 | 0 | 0 | ; BLACK |
| 1 | 0+R | 1 | 0 | 0 | ; SLIGHT RED GRAY |
| 2 | 0+G | 0 | 1 | 0 | ;SLIGHT GREEN GRAY |
| 3 | 0+RG | 1 | 1 | 0 | ; SLIGHT RED GREEN GRAY |
| 4 | 1 | 1 | 1 | 1 | ; FIRST TRUE GRAY |
| 5 | 1+R | 1 | 1 | 1 | |
| 6 | 1+G | 1 | 2 | 1 | |
| 7 | 1+RG | 2 | 2 | 1 | |
| 8 | 2 | 2 | 2 | 2 | ;SECOND TRUE GRAY |
| 9 | 2+R | 3 | 2 | 2 | |
| 10 | 2+G | 2 | 3 | 2 | |
| 11 | 2+RG | 3 | 3 | 2 | |
| 12 | 3 | 3 | 3 | 3 | ; THIRD TRUE GRAY |
| • | • | • | • | • | |
| • | • | • | • | • | |
| • | • | • | • | • | |
| 248 | 62 | 62 | 62 | 62 | ; SIXTY SECOND TRUE GRAY |
| 249 | 62+R | 63 | 62 | 62 | |
| 250 | 62+G | 62 | 63 | 62 | |
| 251 | 62+RG | 63 | 63 | 62 | |
| 252 | 63 | 63 | 63 | 63 | ; WHITE |
| 253 | 63 | 63 | 63 | 63 | ; NOTICE THE LIMITING AT 63, THE MAX INTENSITY |
| 254 | 63 | 63 | 63 | 63 | |
| 255 | 63 | 63 | 63 | 63 | |

SYSTEM AND METHOD FOR ENHANCING GRAY SCALE OUTPUT ON A COLOR DISPLAY

TECHNICAL FIELD

The invention relates to enhancing gray scale output on a color display.

BACKGROUND OF THE INVENTION

Ultrasound images are generally provided in gray scale, and physicians and medical technicians tend to prefer viewing ultrasound images in gray scale as opposed to in color. The gray scale images provide for enhanced resolution of the image by providing sharpened contrasts between black and white and varying shades of gray. The gray scale image may assist a user studying the image to ascertain problems or identify features that the user might not identify if the image did not have enhanced resolution. The display technology currently in use for viewing ultrasound images utilizes a color display, such as a liquid crystal display (LCD), because some ultrasound imaging techniques, such as Doppler, require the use of color. However, when an image is rendered in gray scale on a color display, there will only be a certain number of gray levels available to represent the image, and thus, resolution and clarity may be lost as the image is mapped to these gray levels for display.

Some color displays limit the number of grays that a user can view on the display to approximately 64 different levels of gray; however, the human eye can typically see about 256 different levels of gray. Due to the display limits, for an image to be displayed, mapping would occur to convert image data from a higher gray resolution into the 64 shades of gray that could be displayed. As shown in the table in FIG. 1, the goal intensity may range from 0 to 255; however, the goal intensity could only be mapped to actual intensities ranging from 0 to 63. Even though the viewer would be able to detect 256 levels of gray, the viewer would only see the 64 different levels of gray actually displayed on the screen, resulting in images that would not have the smoother contrast that would be desired.

Further, when mapping of this sort is used to view gray scale images on a color display, the images that result may have a blotchy-looking appearance. When the image that results loses it clarity and resolution, it would not be an ideal for a doctor or other medical technicians, for example, to analyze and interpret because he/she would be less likely to detect variations between the different gray levels.

Another method proposed for creating better gray scale images on a color display was to transition from image to image in a temporal sense. In making this transition, one image could be illuminated at one gray level, and the next image might be illuminated at a slightly different gray level. Due to the temporal positioning of the images relative to one another, the eye then might perceive intermediate gray levels between the gray levels associated with each of the images. This method reduces the effective frame rate by 2 and might appear to flicker to the viewer. The method does not ensure that a sufficient number of gray levels are displayed nor does it ensure that a smooth transition between gray intensities might be achieved.

Thus, there is a need to enhance the gray level output on a color display. Such an enhancement may provide a smoother transition between gray intensity levels on the color display and improve the clarity and resolution of the images displayed in gray scale.

BRIEF SUMMARY OF THE INVENTION

The present invention is directed to a system and method for enhancing gray scale output on a color display. A wide-ranging input number is entered that identifies a pseudo level of gray to be displayed. A smaller-ranging number, associated with the true gray values that can be displayed on the color display is derived from the input number. An assessment is made as to whether the gray value is the brightest gray possible, and if the gray value is the brightest gray possible, a pixel is set to that gray value on the color display.

In another embodiment of the invention, there is shown a system and method for obtaining a near gray shade on a color display. An input number identifying one of 256 gray levels is selected to be displayed, and a number, associated with the 64 true gray values that can be displayed is extracted from the determined input number. Letting the input number range from zero to 255 and the displayable number range from zero to 63, then the displayable number is equal to the input number divided by 4. The remainder of this division operation can be used to adjust the displayable gray scale number. If the remainder is zero, then no adjustment of the gray value may be needed. If the remainder is one, then the red or blue output may be increased by one. If the remainder is two, the green output may be increased by one. If the remainder is three, then the green output as well as either the red or blue output will each be increased by one. The adjusted pixel then is written to the display and the desired pseudo gray level will be shown on the color display. It is important to note that a gray is displayed on a color display when the red, green and blue parts of the display are driven equally. If the parts are not driven equally but nearly equally, this is referred to as pseudo gray. The actual color imbalance to effect a gray shift is not necessarily the same from one display type to another. Thus, the red, green and blue outputs referenced above are merely examples, and additional embodiments may include variants of these shifts.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIG. 1 is a prior art table showing mapping for gray intensity to show on a color display;

FIG. 2 is a flow chart showing an embodiment of a method of an embodiment of the invention;

DETAILED DESCRIPTION OF THE INVENTION

Figures 3, 4:
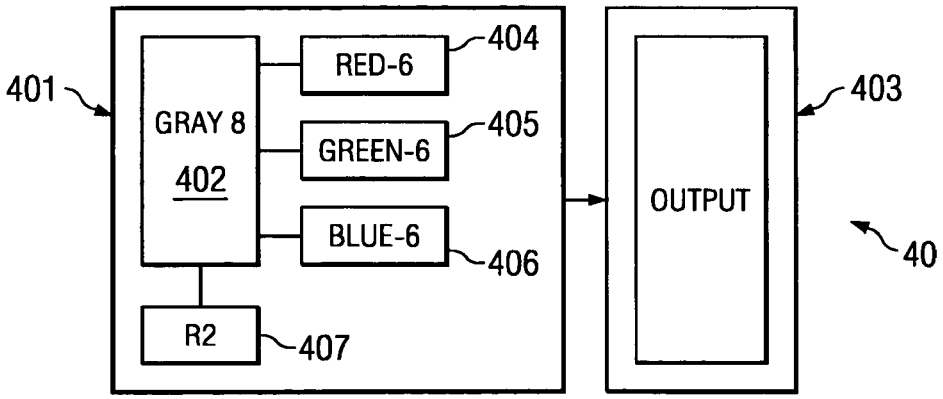
FIG. 3 is a table showing mapping for gray intensity to show on a color display according to an embodiment of the invention.
FIG. 4 depicts a system for enhancing gray scale output according to an embodiment of the invention.

When displaying levels of gray on a color display, typically the screen will display fewer levels of the gray than the human eye may be able to perceive. The number of true levels of gray that may be displayed depends on the type of color display that is being used. There are three parts of a typical color display pixel (red, green and blue), and for example, each part may be represented by 6-bits of data. It follows that there are 64 possible states or levels of true gray that might be displayed based on the different combinations of the parts of the pixel that may be made. In order to display a level of true gray, the drive settings for the red, green and blue parts of a pixel are set to equal values, and the intensity or luminescence of the drive settings may be adjusted to obtain a desired shade of gray of the available gray scale.

The present invention takes an image to be represented in various shades of gray and maps the various gray intensities so that a viewer perceives a depth of gray levels beyond those available in gray scale from the display system. For example, as previously discussed, the average human may perceive approximately 256 shades of gray, although many color display systems can only show 64 true shades of gray. However, using concepts of the present invention, such a color display system may be operated to provide pseudo gray levels, such as may be provided between each of the foregoing 64 true shades of gray, to allow a viewer to perceive 256 (or more) shades of gray on the color display system. This then would result in the display of pseudo shades of gray between the levels of true gray that typically are displayed in order to provide a smoother transition between the levels of true gray that are displayed.

In order to create these perceived additional intensities of gray, a modified classical mapping for gray intensity to color drive settings for a 6-bit per color display may be used according to embodiments of the invention. This type of mapping results in 256 shades of gray that includes the classical 64 shades that typically may be displayed on a color display plus intermediate near gray shades that may be perceived as additional intensities of gray. This modified gray mapping will make a smoother transition between the different intensities of gray. Accordingly, more or fewer adjustments may be made depending on the quality of the display being used. Also, the human observer may desire more or fewer adjustments depending on the strength of the observer's vision.

On a display that is capable of showing multiple levels of gray (e.g., 64 levels of gray), it has been discovered that each of these gray levels may be altered slightly to provide a pseudo gray level very near the true gray level by making adjustments to one or more of the three drive settings that are associated with a pixel. One drive setting is red, while another is green, and a third drive setting is blue. When each of these drive settings are activated equally, the pixel that results on the display will be a single shade of gray. By adjusting the intensity of these drive settings, the different gray levels may be selected. The brightest gray shade that could be obtained would be a white pixel, and the darkest gray would be a black pixel. The pixels in between the brightest gray and the darkest gray will be different shades of gray. However, for a particular gray level, the red, green and blue drive settings may be adjusted to create additional pseudo levels of gray for display which, although actually being a color pixel, are perceived by a user to be a level of gray in the gray scale image.

When a gray scale image is formed, the three drive settings associated with a pixel of the image initially would be set to an equal levels and the pixel would be at a particular gray level. In contrast, if an image containing color is displayed, the drive settings may be adjusted to different levels. In the present invention, the drive settings are adjusted slightly based on the pseudo level of gray that is desired. Although colors are displayed, the colors that are produced are close to a desired level of gray. Thus, when used in an otherwise gray scale image, the colors will be perceived by the user as gray scale and will provide greater contrast and resolution to the image when displayed.

The level of gray for the pixel to be displayed would fall in between one of the 64 levels of true gray and the next level of gray on the scale. For example, when the blue drive setting is increased to a higher intensity and the red and green drive settings remain unchanged, then a slightly blue-gray shade will result with respect to that pixel. The pixel may have a slight blue color, but to the human eye, when the amount of adjustment to the blue level is small and the resulting pixel is included in an otherwise gray scale image, the pixel will appear to be gray. Alternatively, a different level of pseudo gray would be shown on the display when the green drive setting is adjusted to a higher intensity while the red and blue drive settings remain unchanged. It follows that by adjusting both the blue and the green drive settings at the same time while leaving the red drive setting untouched, a third level of pseudo gray in between the brightest gray and the darkest gray may be shown on the display. Thus, with each level of gray in an image, a plurality of pseudo levels of gray may be generated by adjusting one or more of the drive settings to desired levels. Thus, a display now may show what may be 256 pseudo levels of gray rather than only 64 true levels of gray.

By using this modified form of mapping, a user may perceive 256 levels of gray using a 6-bit display with as much success as when an 8-bit display that naturally displays 256 levels of gray is used. This may be beneficial from a cost standpoint because a 6-bit display may be less costly to purchase than an 8-bit display, and through mapping more levels of gray, results may be achieved that are similar to when an 8-bit display is used. While an embodiment of the invention has been described with respect to mapping 256 pseudo levels of gray on a display that has 64 true levels of gray, it is contemplated that any number of pseudo levels of gray and any number of true levels of gray may be mapped.

FIG. 2 illustrates system 20 which depicts a method of enhancing the gray scale output on a color display. In process 201, an input number may be entered into the system. This input number may be an 8-bit number between zero and 255 and will represent a pseudo level of gray selected from the 256 possible levels that a viewer might perceive. If the number of pseudo gray levels desired is not 256, then the input number entered may be adapted. In process 202, a smaller ranged number, or in this embodiment, the upper 6 bits, of the 8-bit number are extracted. These upper 6 bits are extracted because in this embodiment, a 6-bit display is being used. Thus, the number of bits extracted will be the number of bits associated with the display system being used. In process 203, the 6-bit number associated with each of the red, blue and green drive settings is set to a true gray value. Thus, the system identifies that red is equal to the gray value associated with the 6-bit number, green is equal to that gray value, and blue is also equal to that gray value as in the mapping to the gray levels as shown in FIG. 1. There would be 64 possibilities for this gray value. In process 204, the system assesses whether the gray value associated with the 6-bit number is the brightest gray possible, and if it is, that gray is displayed. In this embodiment, the system checks to see if the 6-bit number is 63, or 111111 in binary, the brightest gray that is possible for display. If it is not the brightest, it can be adjusted if required by assessing the values of the bottom 2 bits remaining from the 8-bit number generated in process 201. This 6-bit and 2-bit selection can be described mathematically by the division operation where the dividend is the original 8-bit number and when divided by 4, the quotient is the upper 6-bits and the remainder is the lower 2-bits. This remainder will have a value of 0, 1, 2 or 3. If the remainder is zero (i.e., both of the lower 2-bits have a value of zero), then the gray value is a displayable true gray value and no adjustment of the intensity is needed. The pixel will be set to that value in process 205, and this pixel will be displayed as the true gray value.

If the 6-bit number was 63, indicating the brightest gray possible, but the process continued in relation to this 6-bit number, then the white pixel value of 63 would overflow onto the color to be increased. The near gray color to be chosen would be 63+1 which would be 1000000 in binary. It should be noted that the seventh bit is a one, and in a 6-bit number, the seventh bit would be lost. Thus, the 7-bit number (64, or 1000000 in binary) would become a 6-bit number (000000). Accordingly, the resulting pixel would not be the gray color that would be desired, and in order to reduce likelihood of color distortion, the true gray value is displayed in process 205 when the system indicates that the brightest gray possible has been obtained.

The remainder indicates how much more brightness is desired. If the remainder is one, then in process 206, the red output for the gray level to be displayed will be increased by one. In this example, a remainder of one may indicate a little more brightness is needed. One way to get more brightness is to increase one of the color drives, and in this embodiment, the red color drive is increased. If the remainder is two, then in process 208, the green output for the gray level to be displayed will be increased by one. In this embodiment, a remainder of two indicates yet a little more brightness may be needed. Again, to achieve more brightness, one of the color drives (e.g., green) is increased. If the remainder is three, then the Red and Green outputs for the gray level to be displayed will be increased by one in process 207 if slightly more brightness is needed. After making the adjustments based on the appropriate remainder that is generated, the resulting pixel then will be set to the appropriate adjusted value in process 205. It should be noted that a determination of which color drive should be increased may be display-dependent. In this embodiment, increasing the red color drive by one, for example, causes a slight increased in perceived brightness. Similarly, increasing the green color drive by one causes slightly more perceived brightness than increasing the red color drive, and further, increasing both the red and green color drives by one will result in still more brightness to be perceived.

Although FIG. 2 has been described with respect to adjusting the red and green outputs to obtain a desirable gray level to be displayed as a pixel on the color display, the system may assign other outputs to the remainders associated with the bottom 2 bits of the 8-bit number, such as other combinations of blue, red and green. Regardless which outputs are adjusted, these outputs are maintained at values as equal as possible to maintain a pixel which will be perceived as gray. According to embodiments, one or two of the outputs may be adjusted by one, and there is generally never more than one of the outputs that differs from the other outputs by more than one level of adjustment. Accordingly, one or two of the outputs are maintained at the true gray values. As in the embodiment shown in FIG. 2, the red output is adjusted by one when the remainder is one, but the green and blue outputs remain equal. Similarly, when the remainder is three, both the red and green outputs are adjusted by one and will be maintained at equal levels while the blue output is one less than the red and green outputs.

For example, in another embodiment, using the method described in FIG. 2, a remainder will be determined based on the bottom 2 bits remaining from the 8-bit number initially entered. If the remainder is 1, then in process 208, the blue output for the gray level to be displayed will be increased by 1. If the remainder is 3, then the blue and green outputs will be increased by 1 in process 209. If the remainder is 2, then the green output is increased by 1 in process 210 as before. The human eye may potentially detect a more bluish tint on the image when the blue output is increased as compared to adjusting the red output in conjunction with the green output, but it is up to the user's eye and the display's color characteristics to determine which adjustment results in a more pleasing image when shown on the color display.

It also is possible that depending on the original image quality, the processes described above with respect to FIG. 2 may be altered, such as if a pinkish tint is observed when the image is displayed. For example, a remainder of three may result according to the present invention, indicating that the green and red outputs should be adjusted. However, once these outputs have been adjusted, further adjustments may be needed in order to achieve the desired gray level.

FIG. 3 is a table depicting how 255 near shades of gray can be generated using the method illustrated in FIG. 2. For example, if the system detects the brightest gray possible, the actual intensity will be 63, and the goal intensity will be in the range of 252-255. If, on the other hand, the darkest gray is detected, the actual and goal intensity will be zero. There will be no remainder, and accordingly, no near shade of gray to map. As the goal intensity increases up from zero, the actual intensity will be adjusted by increasing the red, blue and/or green output as needed.

In an additional embodiment, using this modified gray mapping, the system may shade to green rather than to red in order to obtain an intermediate gray. Then, using this intermediate gray, green and blue may be increased just prior to the transition to the next true gray rather than increasing the red output.

FIG. 4 depicts a system 40 for enhancing gray scale output on a color display according to an embodiment of the invention. A field programmable gate array (FPGA) 401 accepts an input number or 8-bit number 402 that identifies what levels of gray should be shown on the display 403. The FPGA then generates three 6-bit numbers from the 8-bit number 402 with one 6-bit number 404 for the red drive setting, one 6-bit number 405 for the green drive setting, and another 6-bit number 406 for the blue drive setting. In this embodiment, three 6-bit numbers 404, 405, 406 are output to the color display 403.

In the past, the FPGA would take the 8-bit number and eliminate the bottom two bits in order to make a 6-bit number that would represent the red, green or blue in an image that would result on the color display. Further, the three 6-bit numbers generated would be identical in order to match the gray level for that value. This gray level would then be written to the display. However, in this embodiment, the FPGA 401 takes the 8-bit number 402 and generates the 6-bit number 404, 405, 406 for each drive setting (red, green and blue) using the upper 6 bits of the 8-bit number 402. Then, the FPGA 401 analyzes the bottom two bits 407 of the 8-bit number to determine a remainder. If the remainder is zero, then no intermediate shade of gray is needed, and the predetermined shade of gray chosen from the classical 64 shades will be written to the display 403.

The remainder associated with the bottom two bits of the 6-bit number will have a value of 0, 1, 2 or 3. If the remainder has a value of 1, then the intensity associated with the blue drive setting 406 may be ratcheted up by one. Thus, there will be a 6-bit number associated with each of the drive settings, and each of the 6-bit numbers will be equal except for the number associated with the blue drive setting. The number associated with the blue drive setting will be larger than the other two drive settings and will result in a different shade of gray being shown on the display.

Similarly, if the remainder has a value of 2, then the green drive setting 405 will be ratcheted up by one. If the remainder has a value of 3, then both the green drive setting 405 and the blue drive setting 406 will be increased by one. This assessment of remainders continues so that the image that is written to the display 403 may be perceived as having 256 levels of gray when in actuality only 64 true levels of gray are being displayed.

Figure 5:
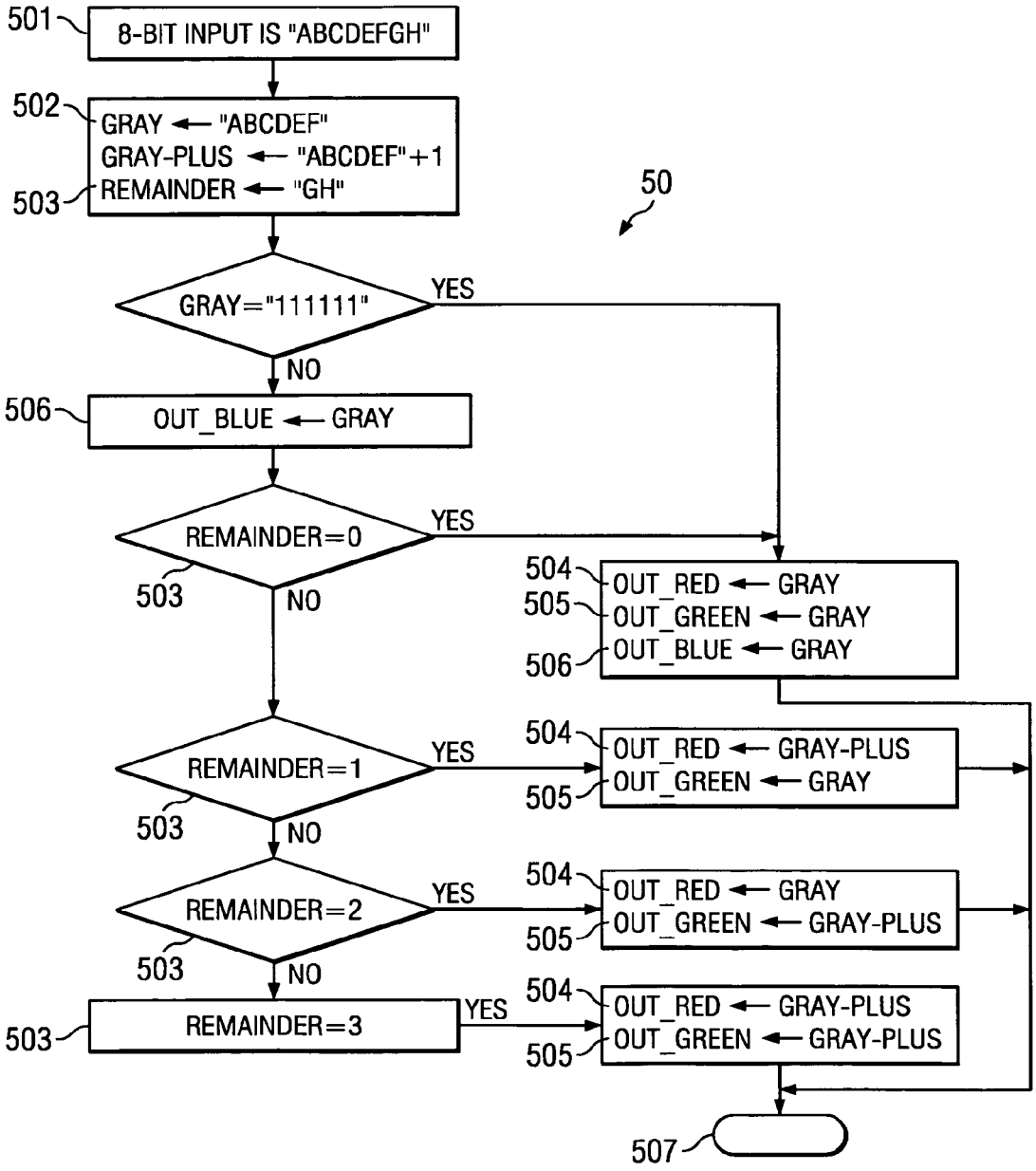
FIG. 5 depicts the operation of an FPGA according to an embodiment of the invention.

In another embodiment of the invention, FIG. 5 depicts the operation of an FPGA 50 used to enhance gray scale output on a color display. The FPGA 50 accepts an 8-bit input number 501, and from this 8-bit input number, a 6-bit number 502 and a remainder 503 are generated. The 6-bit number 502 is associated with a true gray value that can be displayed. The FPGA assesses whether the 6-bit number 502 is associated with the brightest gray that can be displayed. If it is the brightest gray, then the red output 504, the green output 505 and the blue output 506 will be displayed as the true gray value on the color display 507. The same result is achieved by determining that the remainder is zero. However, if the 6-bit number 502 is not associated with the brightest gray possible, the blue output 506 will be displayed as that true gray value, but then the remainder 503 will be analyzed to determine how red output 504 and green output 505 should be adjusted.

If the remainder 503 is one, then the red output 504 will be increased by one and the green output 505 will be displayed as the true gray value. If the remainder 503 is two, then the red output 504 will be displayed as the true gray value, and the green output 505 will be increased by one. If the remainder 503 is three, red output 504 and green output 505 each will be increased by one. After these adjustments have been made based on the remainder 503, the adjusted gray values will be displayed on the color display 507.

When the gray levels displayed on a color display are enhanced, the display still looks gray because the human eye does not perceive the color. The color in the image has shifted, but the human eye does not detect the shift. Thus, the images still look gray to the human eye, but the shifts between colors may appear more intense.

The systems and methods depicted above may be used in a variety of applications. The system may be of use in any product that incorporates any display with limited numbers of shades of gray that it can display, such as LCD, CRT or a plasma display. Although the system has been described with particular reference to an application to ultrasound diagnostics, the system may be used, as examples, in air traffic control operations or in map display functions in an automobile. Other examples include, but are not limited to, the display of sonograms, x-rays, digital photographs, and scanned documents. Therefore, if the users would prefer to view images in gray scale even though the display is in color, as in the ultrasound business, then this system for enhancing the number of levels of gray that can be displayed may be desirable. Further, in an application where imaging is being performed and real color information is not available, then this system may provide a way to enhance the intensity levels of the gray scale image.

It also should be appreciated that the present invention has been described with respect to mapping 256 shades of gray to a display that can show 64 levels of gray. However, any number of gray scales and pseudo gray scales may be mapped according to the present invention.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method for providing pseudo gray levels between true gray levels on a color display, said method comprising:

determining a number of said true gray levels natively supported by said color display, wherein said true gray levels each correspond to all color drive settings for a pixel being equal value;

determining an increased number of gray levels desired to be available for display on said color display, wherein said increased number of gray levels includes said true gray levels and said pseudo gray levels, and wherein said increased number of gray levels is a multiple of said number of true gray levels natively supported by said color display;

receiving a number that identifies a level of said increased number of gray levels to be displayed at a select pixel;

dividing said received number by said multiple to compute a quotient;

selecting a true gray level of said true gray levels for the select pixel, said true gray level having each color drive setting for said pixel being equal to said quotient; and based on a remainder value obtained from said dividing, adjusting one or more of said color drive settings of said select pixel to set the select pixel to one of the pseudo gray levels, wherein said pseudo gray level will be perceived as falling between two of said true gray levels.

2. The method of claim 1 wherein said one or more drive settings of said pixel are adjusted by one level.

3. The method of claim 1 wherein there are three drive settings for said pixel.

4. The method of claim 3 wherein one drive setting differs from the other two drive settings by one level.

5. The method of claim 4 wherein said three drive settings are red, green and blue.

6. The method of claim 5 wherein said red drive setting is adjusted.

7. The method of claim 5 wherein said green drive setting is adjusted.

8. The method of claim 5 wherein said red drive setting and said green drive setting are adjusted.

9. A method of enhancing gray scales on a color display, wherein a plurality of color drive settings are used for outputting a pixel, said method comprising:

capturing an image to be represented as multiple shades of gray; and mapping said multiple shades of gray of said image to provide a depth of gray levels for a pixel beyond what is available in true gray scale on said color display, wherein said true gray scale comprises a plurality of gray levels that each correspond to all of said color drive settings for said pixel being equal value, and wherein said mapping comprises:

determining a number of gray levels in said true gray scale;

determining an increased number of gray levels desired to be available for display on said color display to provide said depth, wherein said increased number of levels includes said gray levels of said true gray scale and pseudo gray levels that are perceivable as falling between two levels of said true gray scale;

receiving for said pixel in said image, a number that identifies a level of said increased number of gray levels to be displayed at said pixel;

dividing said received number by a ratio of said increased number of gray levels to said number of gray levels in said true gray scale to compute a quotient:

selecting a gray level of said true gray scale for the pixel said selected gray level having each of said plurality of color drive settings for said pixel being equal to said quotient; and based on a remainder value obtained from said dividing, adjusting one or more of said color drive settings of said pixel to set the select pixel to one of the pseudo gray levels.

10. The method of claim 9 wherein said plurality of color drive settings comprise three drive settings.

11. The method of claim 10 wherein said three drive settings are red, green and blue.

12. The method of claim 11, said method further comprising: adjusting said three drive settings based on the level of brightness needed for display.

13. A method of enhancing gray scale output on a color display, said method comprising:

determining a number of true gray levels natively supported by said color display, wherein said true gray levels each correspond to all color drive settings for a pixel being equal value;

determining a desired number of gray levels to be available for display on said color display, wherein said desired number of gray levels is greater than said number of true gray levels natively supported by said color display and wherein said desired number of gray levels is a multiple of said number of true gray levels natively supported by said color display;

receiving a number that identifies a level of said desired number of gray levels to be displayed at a select pixel;

dividing said received number by said multiple to compute a quotient, wherein said quotient provides a preliminary value for each of the color drive settings for the select pixel;

based on a remainder obtained from said dividing, determining an adjustment to said preliminary value tier at least one of the color drive settings for the select pixel; and using said color drive settings to output the select pixel on said color display.

14. The method of claim 13 wherein said color drive settings comprise red, green, and blue drive settings, and wherein the method further comprising:

when said remainder is zero, determining no adjustment to be made to said preliminary value % r any of the color drive settings for the select pixel;

when said remainder is a first non-zero value, determining an increase in intensity of said red or blue drive setting;

when said remainder is second non-zero value, determining an increase in intensity of said green drive setting; and when said remainder is a third non-zero value, determining an increase in intensity of said green drive setting and an increase in intensity of one of said red and blue drive setting.

15. The method of claim 13 wherein said multiple is four.

16. The method of claim 15 wherein said number of true gray levels natively supported by said color display is 64, and wherein said desired number of gray levels to be available for display on said color display is 256.

17. A method of enhancing gray scale output on a color display, said method comprising:

determining a number of true gray levels natively supported by said color display, wherein said true gray levels each correspond to all color drive settings for a pixel being equal value;

determining a desired number of gray levels to be available for display on said color display, wherein said desired number of gray levels is greater than said number of true gray levels natively supported by said color display;

receiving a number that identifies a level of said desired number of gray levels to be displayed at a pixel;

dividing said received number by a ratio of said desired number of gray levels to said number of true gray levels natively supported by said color display to compute a quotient, wherein said quotient provides a preliminary value for each of the color drive settings for the select pixel;

when a remainder obtained from said dividing is zero, setting each of the color drive settings to the preliminary value for outputting the select pixel; and when said remainder obtained from said dividing is non-zero, adjusting said preliminary value for at least one of the color drive settings for outputting the select pixel.

18. The method of claim 17 wherein said color drive settings comprise red, green, and blue drive settings, and wherein the method further comprising:

when said remainder is a first non-zero value, determining an increase in intensity of said red or blue drive setting;

when said remainder is second non-zero value, determining an increase in intensity of said green drive setting; and when said remainder is a third non-zero value, determining an increase in intensity of said green drive setting and an increase in intensity of one of said red and blue drive setting.

19. The method of claim 17 wherein said ratio is 4/1.

20. The method of claim 19 wherein said number of true gray levels natively supported by said color display is 64, and wherein said desired number of gray levels to be available tot display on said color display is 256.

* * * * *

UNITED STATES PATENT AND TRADEMARK OFFICE

CERTIFICATE OF CORRECTION

PATENT NO. : 7,643,040 B1
APPLICATION NO. : 10/821198
DATED : January 5, 2010
INVENTOR(S) : Donn E. Gabrielson et al.

It is certified that error appears in the above-identified patent and that said Letters Patent is hereby corrected as shown below:

In the Claims:

Column 10, Claim 14, Line 7, delete the portion of text reading "% r" and replace with --for--.

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,643,040 B1
APPLICATION NO. : 10/821198
DATED : January 5, 2010
INVENTOR(S) : Gabrielson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1672 days.

Signed and Sealed this

Sixteenth Day of November, 2010

David J. Kappos

David J. Kappos
*Director of the United States Patent and Trademark Office*